US012421713B2

(12) United States Patent
Petricca et al.

(10) Patent No.: US 12,421,713 B2
(45) Date of Patent: Sep. 23, 2025

(54) REINFORCEMENT APPARATUS FOR CONCRETE

(71) Applicant: Unistress Corp., Pittsfield, MA (US)

(72) Inventors: Perri Christopher Petricca, Lanesborough, MA (US); Jeffrey Zocchi, Cheshire, MA (US); John Alan LeBihan, Glens Falls, NY (US)

(73) Assignee: Unistress Corp., Pittsfield, MA (US)

( * ) Notice: Subject to any disclaimer, the term of this patent is extended or adjusted under 35 U.S.C. 154(b) by 323 days.

(21) Appl. No.: 18/331,659

(22) Filed: Jun. 8, 2023

(65) Prior Publication Data

US 2024/0410156 A1 Dec. 12, 2024

(51) Int. Cl.
*E04B 1/24* (2006.01)

(52) U.S. Cl.
CPC .... *E04B 1/2403* (2013.01); *E04B 2001/2415* (2013.01)

(58) Field of Classification Search
CPC ..... E04B 1/2403; E04B 2001/2415
See application file for complete search history.

(56) References Cited

U.S. PATENT DOCUMENTS

| | | | | |
|---|---|---|---|---|
| 6,494,639 | B1 | 12/2002 | Friend | |
| 7,640,702 | B2 * | 1/2010 | Termohlen | E04C 3/34 52/261 |
| 10,233,630 | B1 * | 3/2019 | Francies, III | E04B 1/2608 |
| 10,731,330 | B2 | 8/2020 | Petricca | |
| 10,829,945 | B2 | 11/2020 | Thorp | |
| 10,883,265 | B2 | 1/2021 | Kelly et al. | |
| 11,060,275 | B2 | 7/2021 | Kucera | |
| 11,492,797 | B2 | 11/2022 | Recker et al. | |

(Continued)

FOREIGN PATENT DOCUMENTS

| | | |
|---|---|---|
| CN | 107700674 A | 2/2018 |
| CN | 110878596 A | 3/2020 |

OTHER PUBLICATIONS

Beni, M.B. Tadi et al. "Experimental study on two innovative ductile moment-resisting precast concrete beam-column connections" Structures. vol. 39. May 2022. pp. 559-572.

(Continued)

*Primary Examiner* — Rodney Mintz
(74) *Attorney, Agent, or Firm* — Hamilton, Brook, Smith & Reynolds, P.C.

(57) ABSTRACT

A corbel mounting assembly can include a corbel mounting member having a concrete anchor arrangement and a planar corbel mounting surface. The planar corbel mounting surface can extend along a mounting plane. A beam securement member is also included, having a concrete anchor arrangement and a planar beam securement surface. The beam securement member can be rigidly secured to and spaced apart from the corbel mounting member by a connecting member. The planar corbel mounting surface and the planar beam securement surface can be aligned with each other along the mounting plane. The connecting member can have a connecting member surface extending along a connecting member surface plane that is spaced apart from and parallel to the mounting plane. The connecting member can extend interactively relative to the concrete anchor arrangements of the corbel mounting member and the beam securement member.

16 Claims, 13 Drawing Sheets

(56) References Cited

U.S. PATENT DOCUMENTS

| | | | | |
|---|---|---|---|---|
| 11,866,251 | B2 * | 1/2024 | Mirzoyan | B65D 90/54 |
| 12,158,007 | B2 * | 12/2024 | Osmanski | E04F 13/0857 |
| 2008/0295427 | A1 * | 12/2008 | Termohlen | E04C 3/34 52/263 |
| 2015/0240493 | A1 * | 8/2015 | Lee | E04C 5/0645 52/712 |
| 2018/0347179 | A1 * | 12/2018 | Kelly | E04B 1/4114 |
| 2019/0119908 | A1 * | 4/2019 | Petricca | E04B 1/41 |
| 2019/0309533 | A1 * | 10/2019 | Thorp | E04B 1/4114 |
| 2020/0318341 | A1 * | 10/2020 | Jablonsky | E04B 1/215 |
| 2021/0123232 | A1 * | 4/2021 | Kucera | E04B 1/215 |
| 2021/0238861 | A1 * | 8/2021 | Osmanski | E04F 13/0805 |
| 2021/0277650 | A1 * | 9/2021 | Recker | E04B 1/41 |
| 2022/0356007 | A1 * | 11/2022 | Mirzoyan | E04H 7/065 |

OTHER PUBLICATIONS

Bahrami, et al., "Performance of the modified precast beam to column connection placed on a concrete corbel." Civil Engineering Infrastructures Journal 52.2 (2019): 365-377.

"DN-32 Connections for Architectural Precast" downloaded from URL: https://www.enterpriseprecast.com/uploads/Image/resources/DN-32-Connections-for-Architectural-Precast.pdf (Accessed Apr. 11, 2023).

"WELDA® Anchor Plate" downloaded from URL: https://www.youtube.com/watch?v=YO2paGT9TsA (Accessed Apr. 11, 2023).

"WELDA®/WELDA® Strong Anchor Plates Technical Manual" downloaded from URL: https://media.peikko.com/file/dl/i/WiDMVw/svN_UsFYfy4pOi0vPuxoUg/WELDAandWELDAStrongGroup004TMAWeb.pdf (Accessed Apr. 11, 2023).

* cited by examiner

REINFORCEMENT APPARATUS FOR CONCRETE

BACKGROUND

Concrete structures such as concrete walls can be formed with embedded corbel mounting plates and weld plates. A corbel mounted on the corbel mounting plate can support the leg of a concrete double Tee beam, and the upper end of the leg can be welded to the weld plate, for securing in place. In the prior art, when the concrete walls are being manufactured in a wall casting form, the corbel mounting plates and the weld plates are set up in the wall casting form by separately tying each to rebar cages prior to pouring the concrete.

SUMMARY

The present disclosure includes a corbel mounting assembly for a concrete structure such as a concrete wall, that can be set up in a concrete structure or wall casting form more quickly than prior methods. In addition, when the finished concrete wall is installed on site, the corbel mounting assembly can more securely hold the leg of a concrete beam in place on a corbel that is mounted to the corbel mounting assembly. The corbel mounting assembly can include a corbel mounting member having a concrete anchor arrangement and a planar corbel mounting surface. The planar corbel mounting surface can extend along a mounting plane. A beam securement member is also included, having a concrete anchor arrangement and a planar beam securement surface. The beam securement member can be rigidly secured to and spaced apart from the corbel mounting member by a connecting member. The planar corbel mounting surface and the planar beam securement surface can be aligned with each other along the mounting plane. The connecting member can have a connecting member surface extending along a connecting member surface plane that is spaced apart from and parallel to the mounting plane. The connecting member can extend interactively relative to the concrete anchor arrangements of the corbel mounting member and the beam securement member.

In particular embodiments, the corbel mounting member and the beam securement member can be each formed of planar steel plates. The concrete anchor arrangements of the corbel mounting member and the beam securement member can each include at least two elongate anchor members rigidly extending from respective corbel mounting and beam securement members in a direction opposite to the mounting plane. The connecting member can include two parallel elongate steel bars rigidly secured to respective anchor members on the corbel mounting member and the beam securement member. The connecting member surface of the two steel bars can extend along the connecting member surface plane spaced apart from the mounting plane by at least 1½ inches. In some embodiments, the corbel mounting member can be about 15 to 18 inches wide by 12 to 14 inches high and ½ inch thick. The beam securement member can be about 7 to 10 inches wide by 2 to 4 inches high and ½ inch thick. The elongate steel bars can be about ½ inch in diameter, and the height of the corbel mounting assembly can be about 27 to 48 inches high. A corbel can be included and mounted to the planar corbel mounting surface. The corbel mounting assembly can be embedded in a concrete wall and can be part of a beam mounting assembly. The planar corbel mounting surface and the planar beam securement surface can extend along an exterior surface of the concrete wall. An upper surface of the corbel can support a bottom of a beam, and the planar beam securement surface can be rigidly secured to an end of the beam, thereby rigidly holding the beam on the upper surface of the corbel with rigid connection of the beam securement member to the corbel mounting member by the connecting member.

The present disclosure can also provide a corbel mounting assembly including a corbel mounting plate having at least two concrete anchor members and a planar corbel mounting surface. The planar corbel mounting surface can extend along a mounting plane. A beam securement plate can be included having at least two concrete anchors and a planar beam securement surface. The beam securement plate can be rigidly secured to and spaced apart from the corbel mounting plate by a connecting member having two parallel elongate bars rigidly secured to respective anchor members on the corbel mounting plate and the beam securement plate. The planar corbel mounting surface and the planar beam securement surface can be aligned with each other along the mounting plane. The two parallel elongate bars of the connecting member can have a connecting member surface extending along a connecting member surface plane that is spaced apart from and parallel to the mounting plane.

The present disclosure can also provide a method of forming a corbel mounting assembly for a concrete structure, that includes providing a corbel mounting member having a concrete anchor arrangement and a planar corbel mounting surface. The planar corbel mounting surface can extend along a mounting plane. A beam securement member can be rigidly secured to the corbel mounting member in a spaced apart manner with a connecting member. The beam securement member can have a concrete anchor arrangement and a planar beam securement surface. The planar corbel mounting surface and the planar beam securement surface can be aligned with each other along the mounting plane. The connecting member can have a connecting member surface extending along a connecting member surface plane that is spaced apart from and parallel to the mounting plane. The connecting member can extend interactively relative to the concrete anchor arrangements of the corbel mounting member and the beam securement member.

In particular embodiments, the corbel mounting member and the beam securement member can each be formed of planar steel plates. The concrete anchor arrangements of the corbel mounting member and the beam securement member can be each provided with at least two elongate anchor members rigidly extending from respective corbel mounting and beam securement members in a direction opposite to the mounting plane. The connecting member can be provided with two parallel elongate steel bars rigidly secured to respective anchor members on the corbel mounting member and the beam securement member. The connecting member surface of the two steel bars can extend along the connecting member surface plane spaced apart from the mounting plane by at least 1½ inches. In some embodiments, the corbel mounting member can be about 15 to 18 inches wide by 12 to 14 inches high and ½ inch thick. The beam securement member can be about 7 to 10 inches wide by 2 to 4 inches high and ½ inch thick. The elongate steel bars can be about ½ inch in diameter, and the height of the corbel mounting assembly can be about 27 to 48 inches high. A corbel can be mounted to the planar corbel mounting member. The corbel mounting assembly can be embedded in a concrete wall. The planar corbel mounting surface and the planar beam securement surface can extend along an exterior surface of the concrete wall. The corbel mounting assembly can be part of a beam mounting assembly where a bottom of a beam can be supported with an upper surface of the corbel. An end of the beam can be rigidly secured to the beam securement surface, thereby rigidly holding the beam on the upper surface of the corbel with rigid connection of the beam securement member to the corbel mounting member by the connecting member.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

A description of example embodiments follows.

Figure 1:
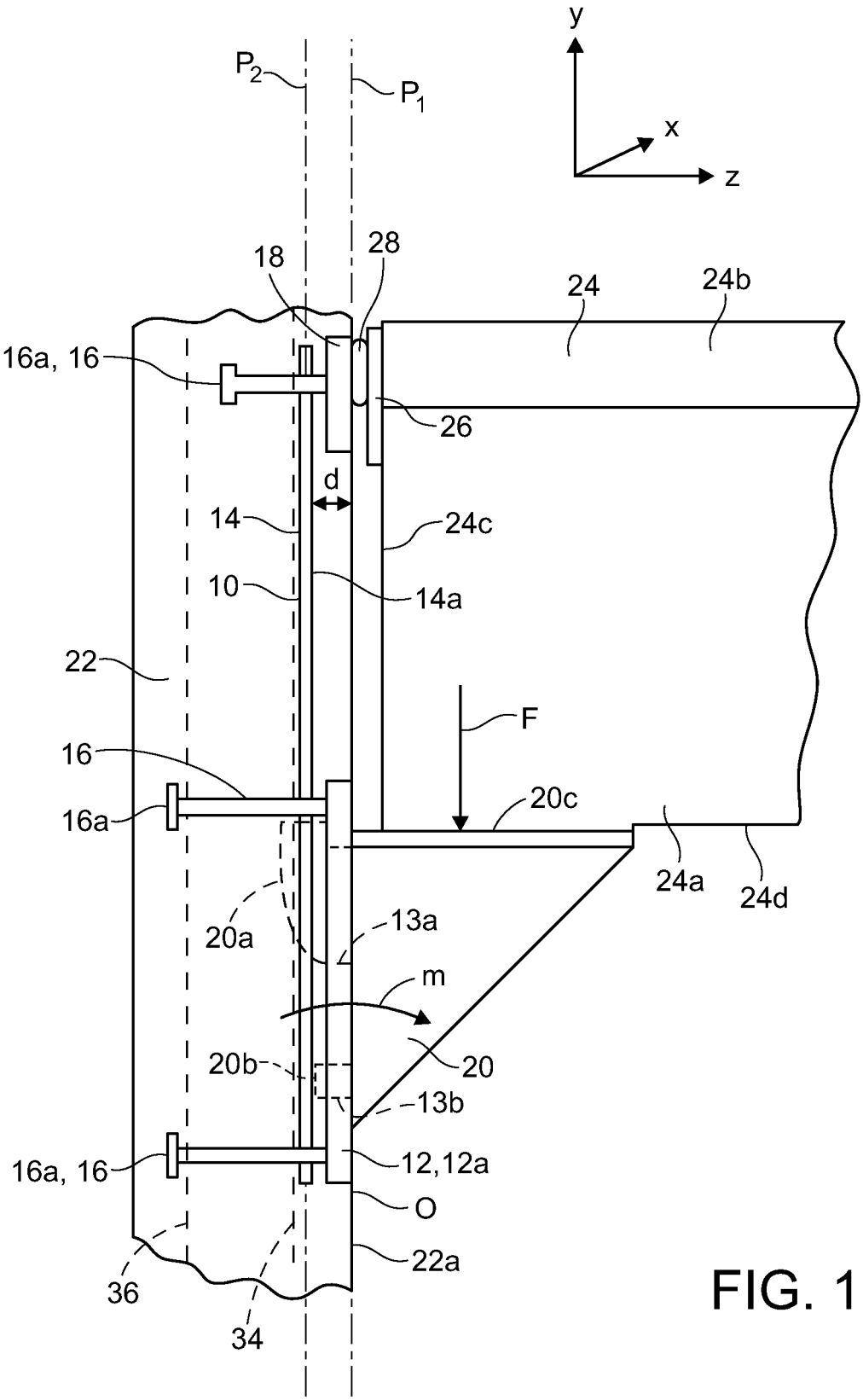
FIG. 1 is a side schematic drawing of an embodiment of a concrete wall having a corbel mounting assembly supporting a double Tee beam in the present disclosure, and also forming a beam mounting assembly.
Figure 2:
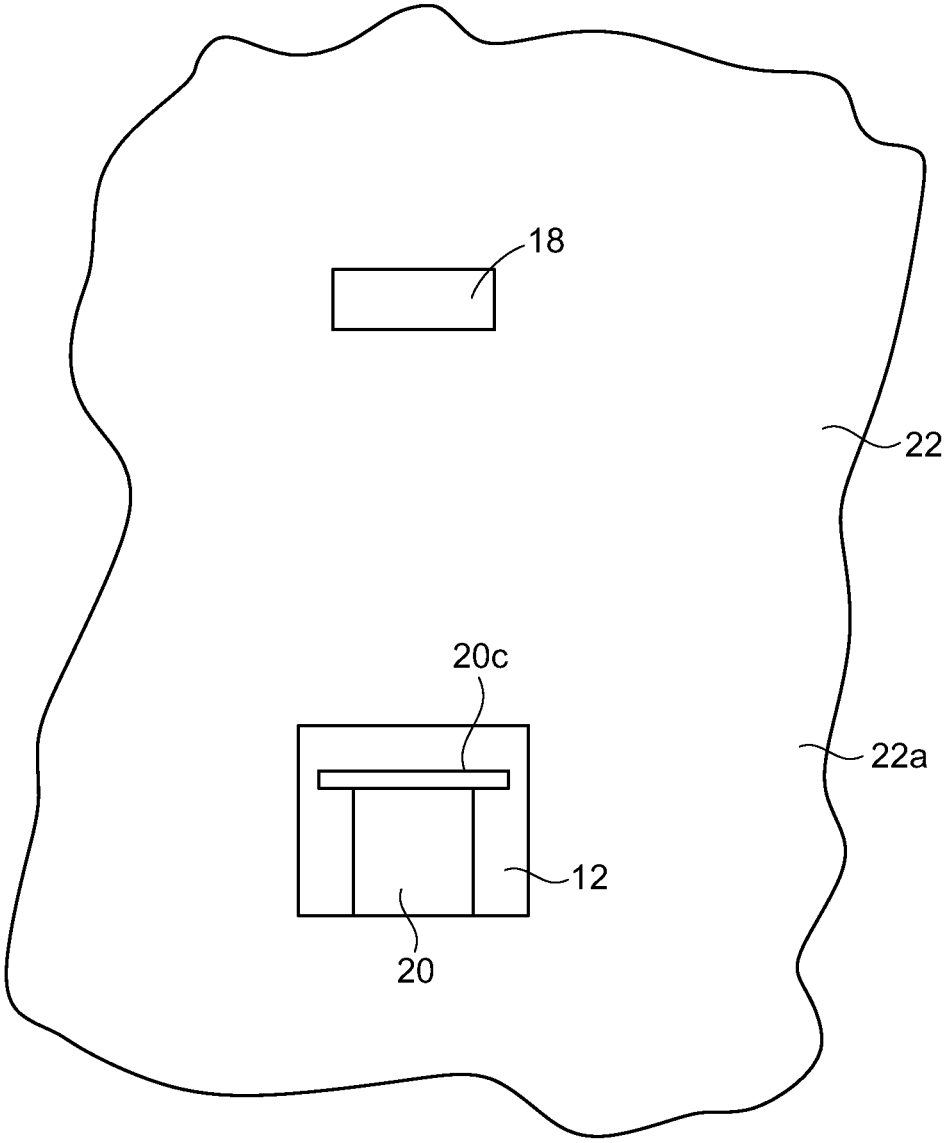
FIG. 2 is a front view of a portion of a concrete wall with a corbel mounting assembly.
Figure 3:
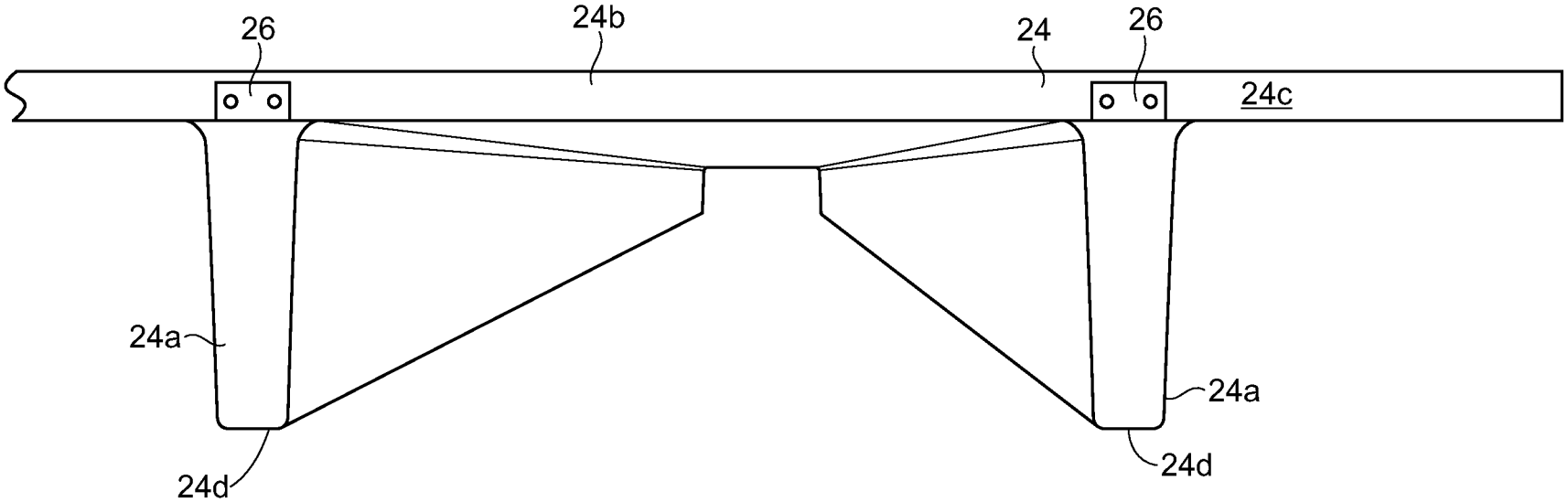
FIG. 3 is an end view of a double Tee beam.
Figure 4:
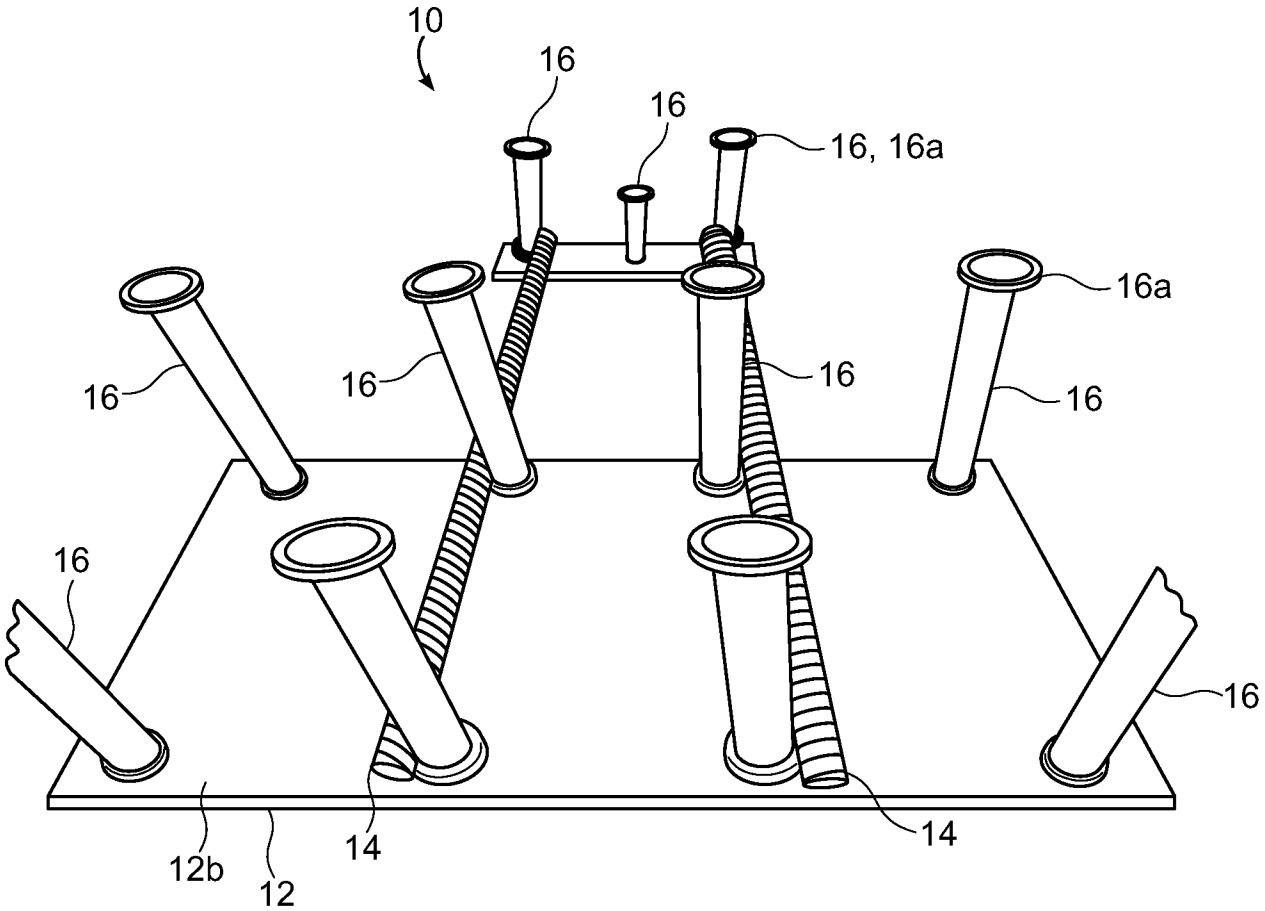
FIG. 4 is a perspective view of an embodiment of a corbel mounting assembly.
Figure 5:
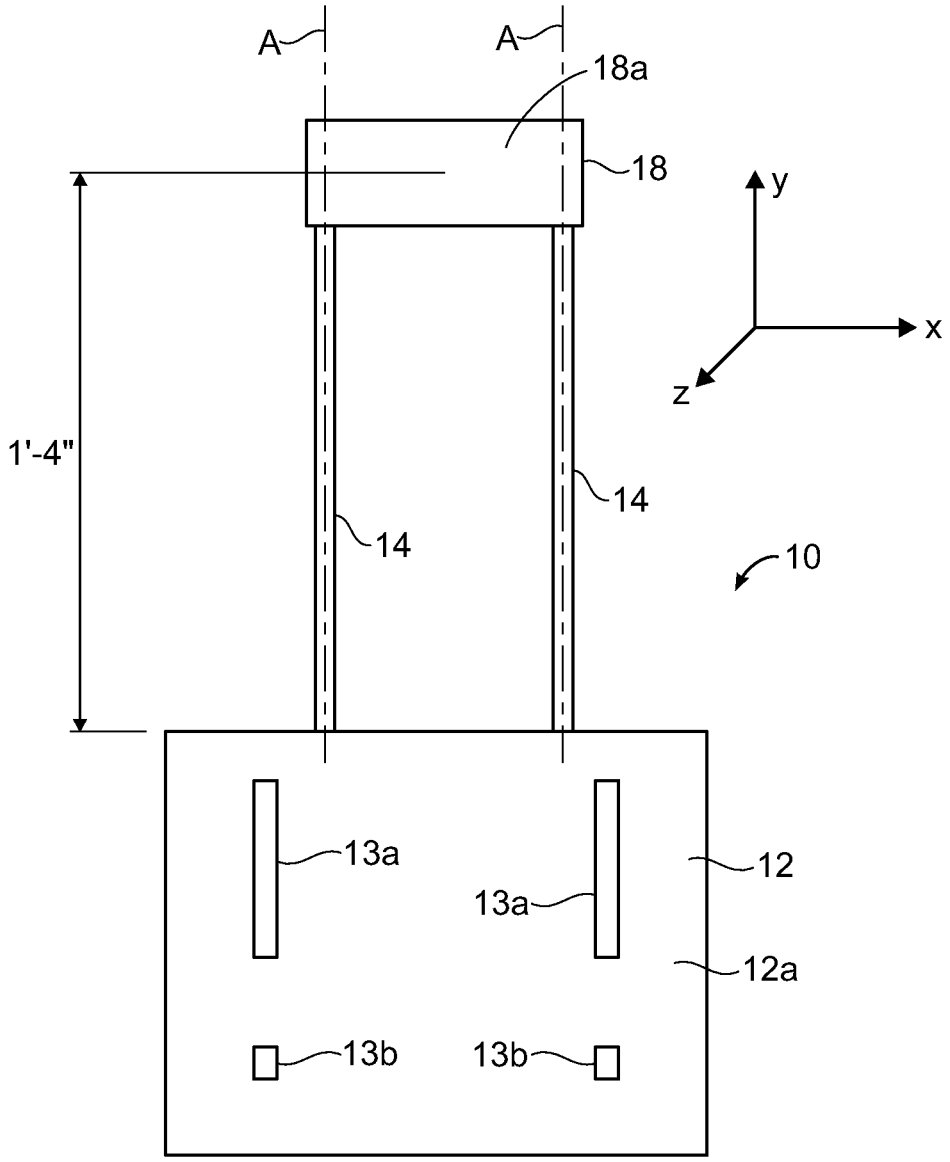
FIG. 5 is a front view of an embodiment of a corbel mounting assembly.
Figure 6:
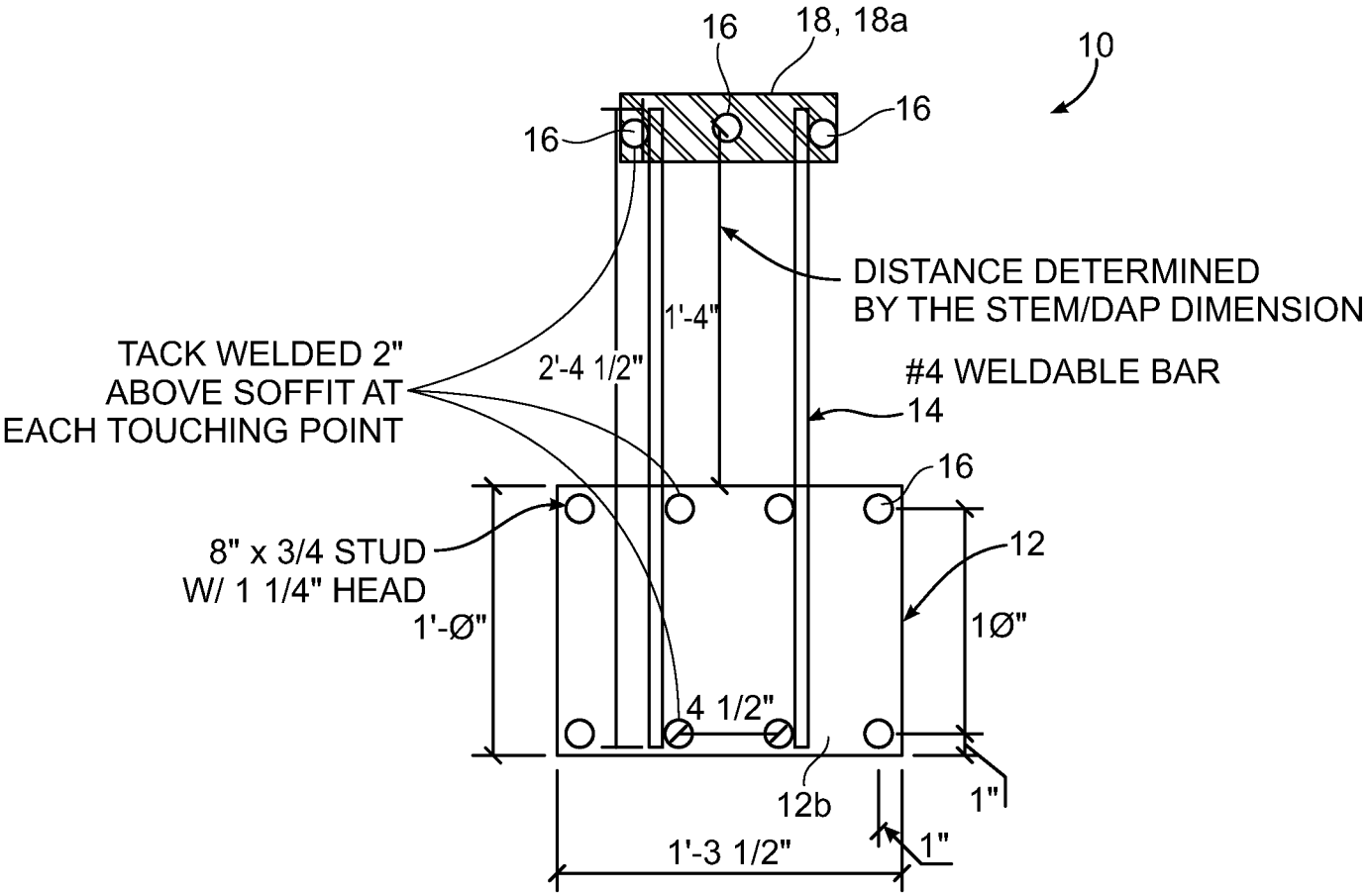
FIG. 6 is a rear view thereof.
Figure 7:
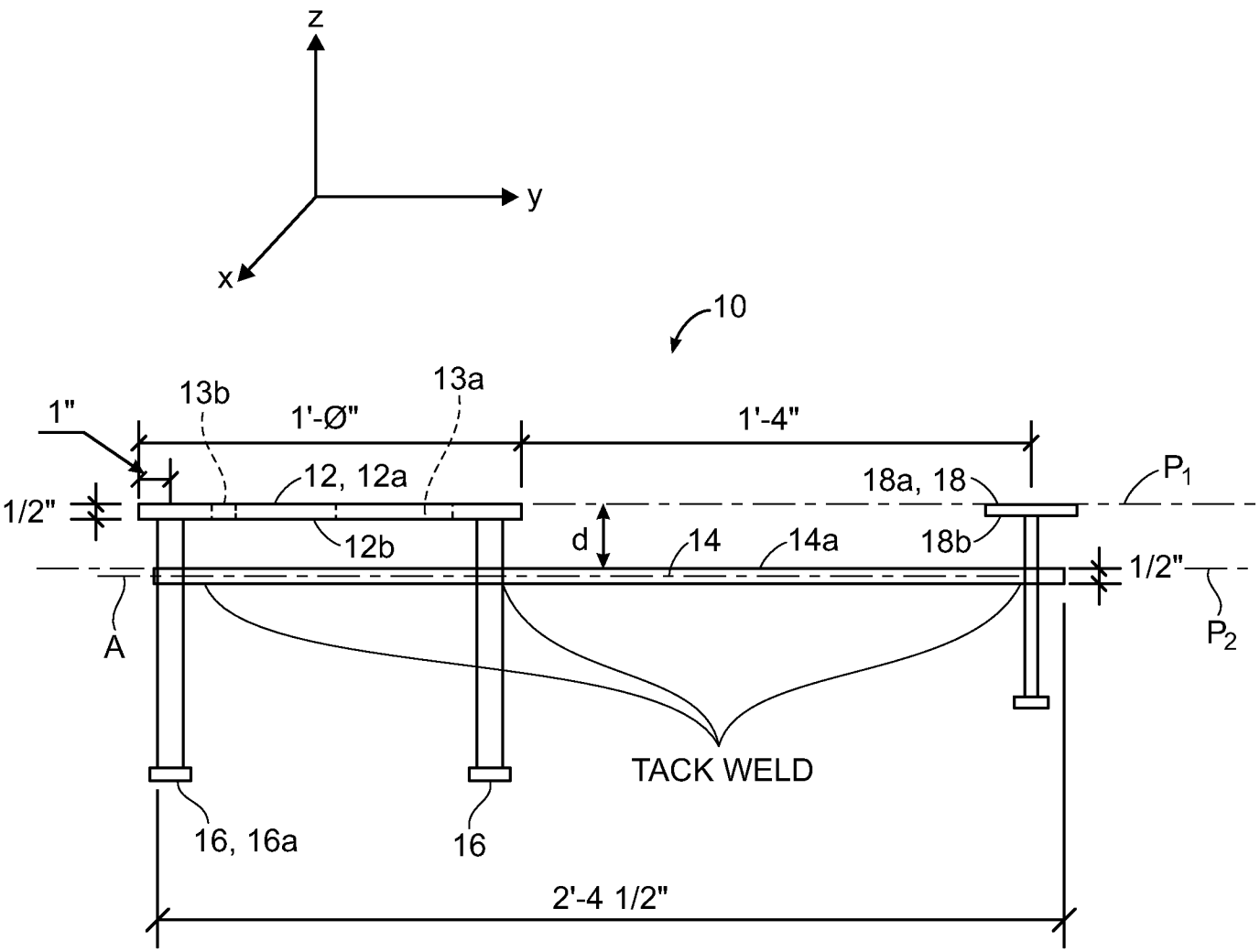
FIG. 7 is a side view thereof.
Figure 8:
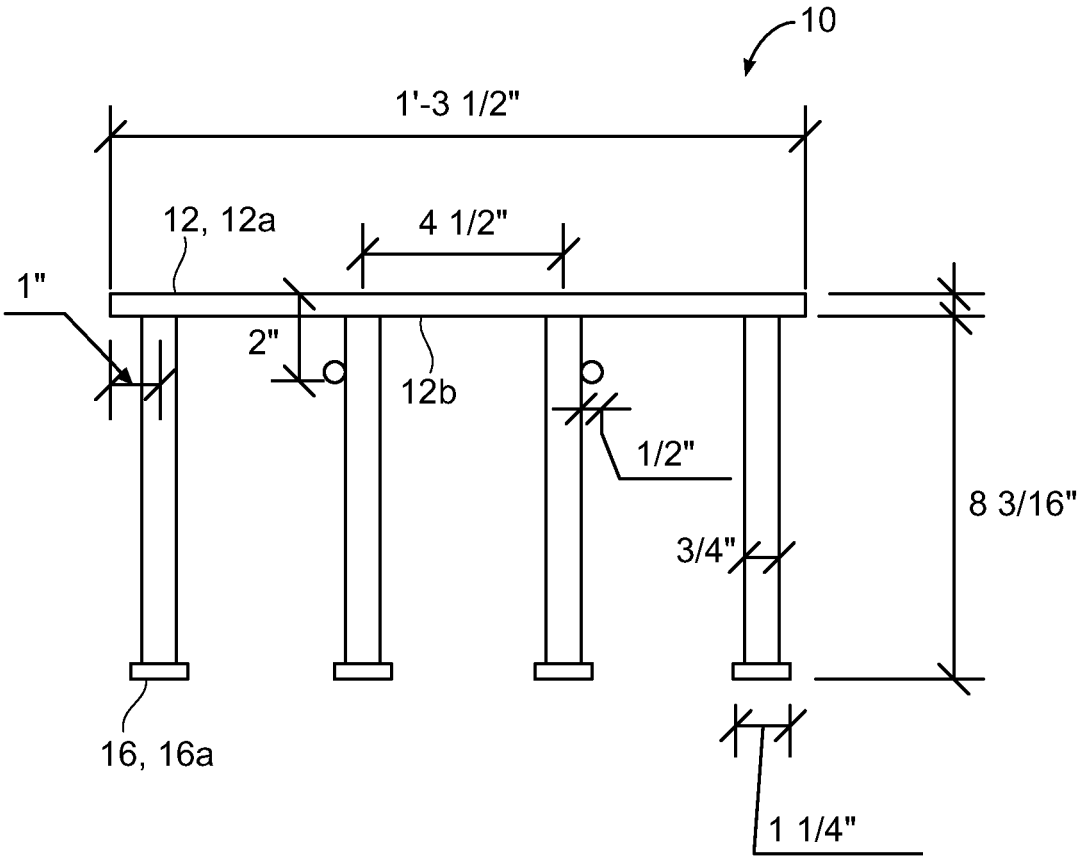
FIG. 8 is an end view thereof.

Referring to FIG. 1, in the present disclosure, a concrete structure such as a concrete wall 22 can have an embodiment of a corbel mounting assembly 10 embedded, formed or cast into the concrete wall 22. The corbel mounting assembly 10 can interact with front and rear rebar cages 34 and 36. The corbel mounting assembly 10 can include a corbel mounting member or plate 12 and a beam securement member or weld plate 18. A corbel 20 (FIG. 2) can be secured to the corbel mounting plate 12. A top or upper surface 20*c* of the corbel 20 supports the bottom surface 24*d* of a stem or leg 24*a* of a concrete double Tee beam 24. The ends 24*c* of the double Tee beam 24 can include an embedded metal securement or weld plate 26 on the upper flange region 24*b* of the double Tee beam 24 aligned with and above each leg 24*a* (FIG. 3). The metal plate 26 at the end 24*c* of the double Tee beam 24 can be rigidly secured to the beam securement plate 18, such as by welding a weld bead 28, to rigidly secure the double Tee beam 24 to the corbel mounting assembly 10 and the concrete wall 22. This can also form a beam mounting assembly. As shown in FIG. 3, a double Tee beam 24 typically has two downwardly extending legs 24*a*, so that a single double Tee beam 24 is supported by two corbel mounting assemblies 10 and associated mounted corbels 20, and is also welded to or against two beam securement plates 18.

Referring to FIGS. 4-8, embodiments of the corbel mounting assembly 10 can include a planar steel corbel mounting member or plate 12 having a planar first, front or corbel mounting surface 12*a* for being generally flush or at the level of a front, exterior or outer surface 22*a* of a concrete structure or wall 22. The corbel mounting surface 12*a* can extend along a front, mounting or wall face plane $P_1$. The mounting plane $P_1$ can lie on an XY axes plane. A planar second, back or rear surface 12*b* can include a first or lower concrete anchor arrangement extending from surface 12*b* in a perpendicular manner rearwardly in a direction opposite to the mounting plane $P_1$. The anchor arrangement can have 8 anchor members, bars or rods 16 each with a head 16*a*, welded to and extending perpendicular from the surface 12*b* of corbel mounting plate 12 rearwardly in a Z axis direction opposite to the mounting plane $P_1$. The anchor rods 16 can be in two rows of four, such as near the top and bottom regions. The corbel mounting plate 12 can include a pair of elongate vertical slots 13*a* positioned above and in line with a pair of smaller slots or openings 13*b* (FIG. 5), for accepting respective locking members or flanges 20*a* and 20*b* of a corbel 20 (FIG. 1) for mounting corbel 20 to the corbel mounting plate 12. The locking flanges 20*a* and 20*b* can extend rearwardly from the corbel 20 to lock the corbel 20 in place on the corbel mounting surface 12. In some embodiments, other suitable slot and locking member arrangements or configurations can be used. Additionally, in other embodiments, the corbel 20 can be mounted, secured or locked to the corbel mounting plate 12 by other suitable methods such as by welding or by bolts.

The corbel mounting plate 12 can be rigidly connected to a planar steel beam securement member or plate 18 by an elongate connecting member which can include two parallel elongate steel connecting bars or rods 14 such as rebar, extending along two respective parallel axes A, in the Y axis direction. The beam securement plate 18 can have a planar first, front or beam securement surface 18*a* for being generally flush or at the level of surface 22*a* of concrete wall 22. A planar second, back or rear surface 18*b* can include a second or upper concrete anchor arrangement extending from surface 18*b* in a perpendicular manner rearwardly in a direction opposite to the mounting plane $P_1$. The anchor arrangement can have three anchor members, bars or rods 16 each with a head 16*a*, welded to and extending perpendicular from surface 18*b* of beam securement plate 18 rearwardly in a Z axis direction opposite to the mounting plane $P_1$, and can be in a single central row.

The planar corbel mounting surface 12*a* and the planar beam securement surface 18*a* can be oriented or aligned with each other along the mounting plane $P_1$, allowing both surfaces 12*a* and 18*a* to be formed in a concrete structure or wall 22, and be flush with or at the same level as a front, exterior or outer surface 22*a*. The two steel connecting rods 14 can be rigidly secured to four anchor rods 16 of the corbel mounting plate 12, two at the top and two at the bottom, such as by welding on the outer sides of the anchor rods 16, and can be rigidly secured to two anchor rods 16 of the beam securement plate 18, such as by welding on the inner sides of the anchor rods 16. Securement of the connecting rods 14 to the anchor rods 16 allows the connecting rods 14 to be positioned a desired distance d away from the mounting plane $P_1$. For example, the front surfaces 14*a* of the connecting rods 14 can be aligned parallel to each other along a connecting member surface plane $P_2$ that is spaced rearwardly apart from and parallel to the mounting plane $P_1$ by distance d of 1½ inches or at least 1½ inches in the Z axis direction. The connecting member surface plane $P_2$ can lie along an XY axes plane. This can position the connecting rods 14 at least 1½ inches rearwardly under the surface 22*a* of concrete wall 22, for better securement within concrete wall 22 and better strength.

The dimensions of the corbel mounting assembly 10 can vary depending upon the size of the double Tee beam 24 that is being supported. In some embodiments, the height of the corbel mounting assembly 10 can be about 27 to 48 inches high and in one embodiment about 29½ inches high. The corbel mounting plate 12 can be about 15 to 18 inches wide by about 12 to 14 inches high and about ½ inch thick, and in one embodiment, can be 15½ inches wide by 12 inches high. The anchor rods 16 on the corbel mounting plate 12 can have a round cross section with about a ¾ inch diameter with a 1¼ diameter head 16*a*, and can be about 8½ inches long. Each row of anchor rods 16 can space the anchor rods 16 on the corbel mounting plate 12 about 4½ inches apart, and the two rows at the top and bottom regions can be about 10 inches apart. The connecting rods 14 can have a round cross section and can be about ½ inch in diameter and can space the center of the beam securement plate 18 from the top of the corbel mounting plate 12 about 16 inches in one embodiment, and in other embodiments can be spaced about 15 to 28 inches. The beam securement plate 18 can be about 7 to 10 inches wide by 2 to 4 inches high, and ½ inch thick, and in one embodiment, can be 7⅞ inches wide and 2⅞ inches high. Three anchor rods 16 can extend from beam securement plate 18 and can be about 6 to 7 inches long. In some embodiments, components of a Rapid-Lok™ corbel arrangement can be incorporated into corbel mounting assembly 10, such as on the corbel mounting plate 12.

Figure 9:
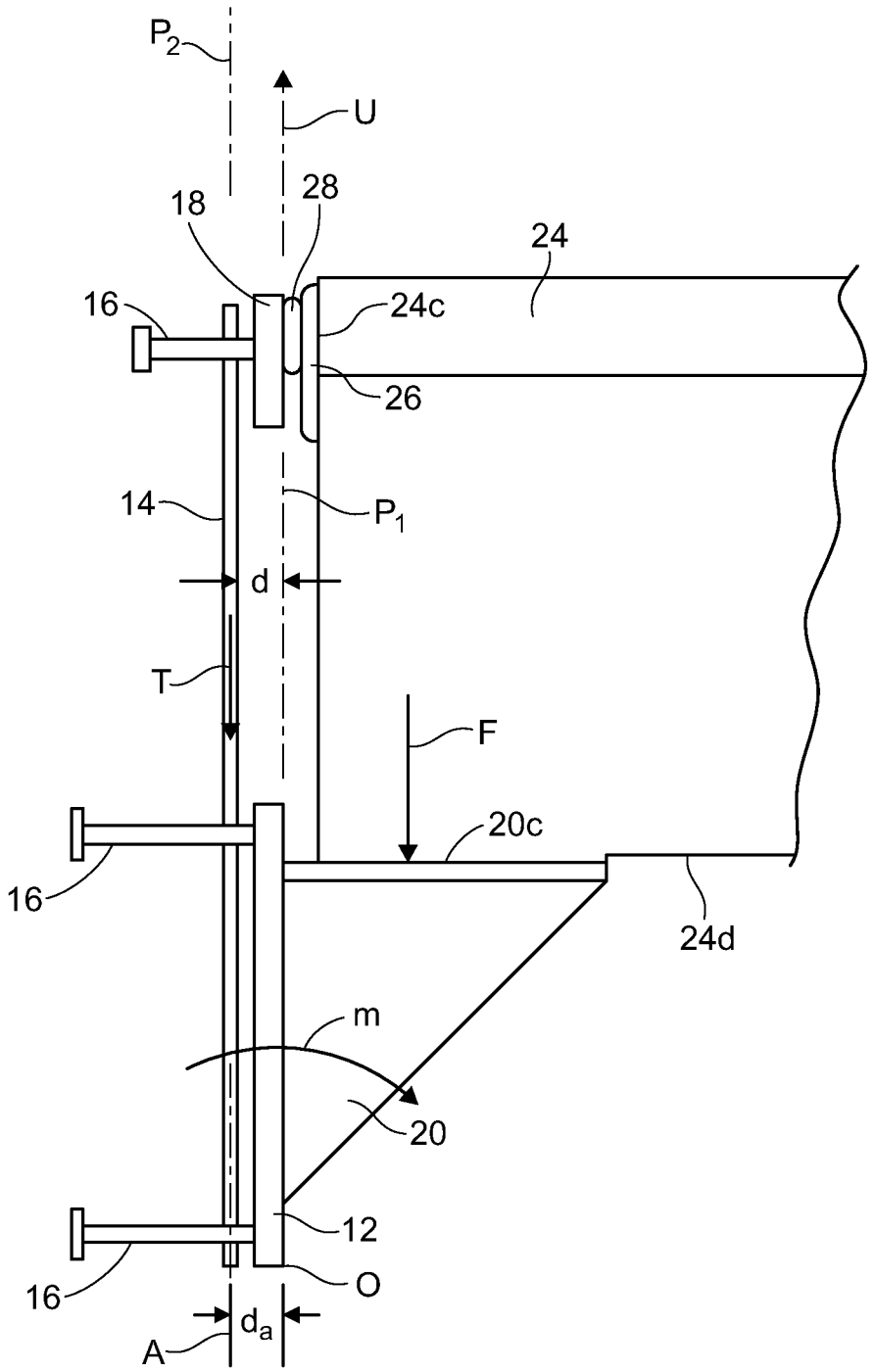
FIGS. 9 and 10 are schematic drawings depicting tension forces on a connecting member of a corbel mounting assembly in response to an upward force on a double Tee beam.
Figure 10:
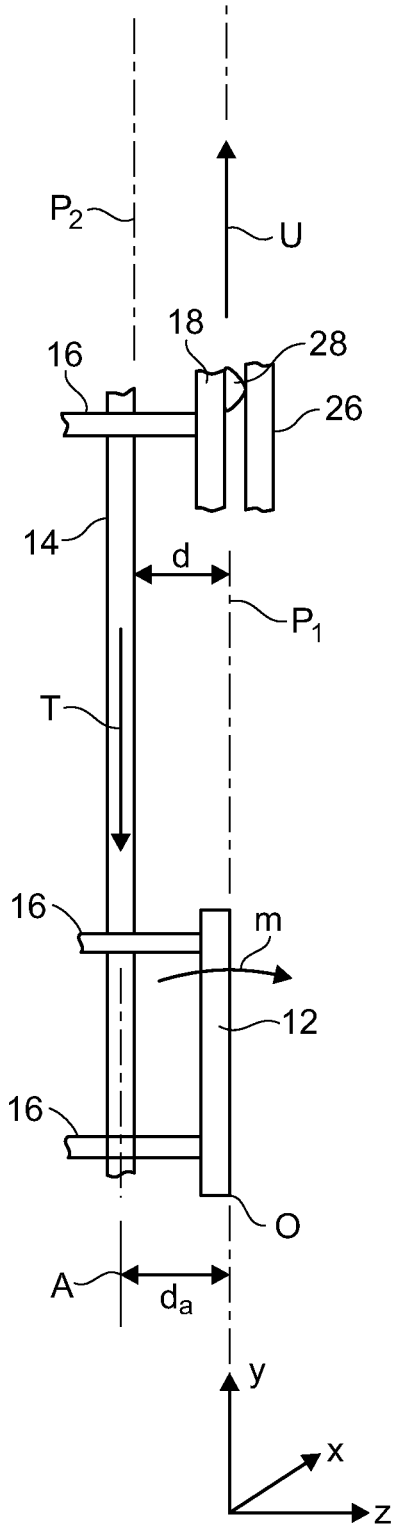

Referring to FIGS. 1, 9 and 10, by rigidly securing beam securement plate 18 to the corbel mounting plate 12 with connecting rods 14, the double Tee beam 24 that is supported by corbel 12, can be more securely held in place once beam securement plate 18 is welded to the plate 26 on the end 24*c* of the double Tee beam 24. For example, if external forces such as an earthquake or a vehicle driving over the double Tee beam 24 causes an upward force U on the double Tee beam 24, the connecting rods 14 that rigidly secure the beam securement plate 18 to the corbel mounting plate 12 can resist the upward force U with opposite tension force T along the parallel axes A to keep the double Tee beam 24 held tight in position on the top surface 20*c* of the corbel 20. This can provide resistance to upward forces U even if portions of the concrete wall 22 between the beam securement plate 18 and the corbel mounting plate 12 deteriorate over time. Rigid securement connecting the following components together in series, the plate 26 on the end 24*c* of the double Tee beam 24, the beam securement plate 18, the anchor rods 16 extending from the beam securement plate 18, the connecting rods 14, the anchor rods 16 extending from the corbel mounting plate 12, and the corbel mounting plate 12, lock the double Tee beam 24 in place over the top surface 20*c* of the corbel 20, once the double Tee beam 24 is welded to the beam securement plate 18 by weld 28. Upward force U of the double Tee beam 24 is directed on the beam securement plate 18 along mounting plane $P_1$ but is resisted by the tension force T on the connecting rods 14 along axes A rearwardly offset from the mounting plane $P_1$ by distance $d_a$. The connecting rods 14 rigidly secure the beam securement plate 18 to the corbel mounting plate 12 and associated anchor rods 16, and can provide greater resistance to the upward force U. Rigidly securing two spaced apart connecting rods 14 to anchor rods 16 at the top and bottom of the corbel mounting plate 12 can more evenly spread out the forces transmitted by the connecting rods 14 over the corbel mounting plate 12 for better force absorption.

In addition, under normal conditions, the weight of the double Tee beam 24 exerts a load or force F from each leg 24*a* generally onto a corbel 20 and corbel mounting plate 12, and then onto the concrete wall 22. The load F can also exert a moment M on the corbel mounting plate 12 about pivot point O at the bottom front edge of the mounting plate 12. With the corbel mounting plate 12 being rigidly secured to the beam securement plate 18 by the connecting rods 14 above the corbel mounting plate 12, both the downward force F and the moment M about pivot point O can be resisted by both the anchor rods 16 of the corbel mounting plate 12, and the anchor rods 16 of the beam securement plate 18, thereby providing increased strength for supporting the double Tee beam 24. In addition, the connecting rods 14 can also provide resistance against the moment about pivot point O since the connecting rods 14 are embedded in the concrete 30.

Figure 11:
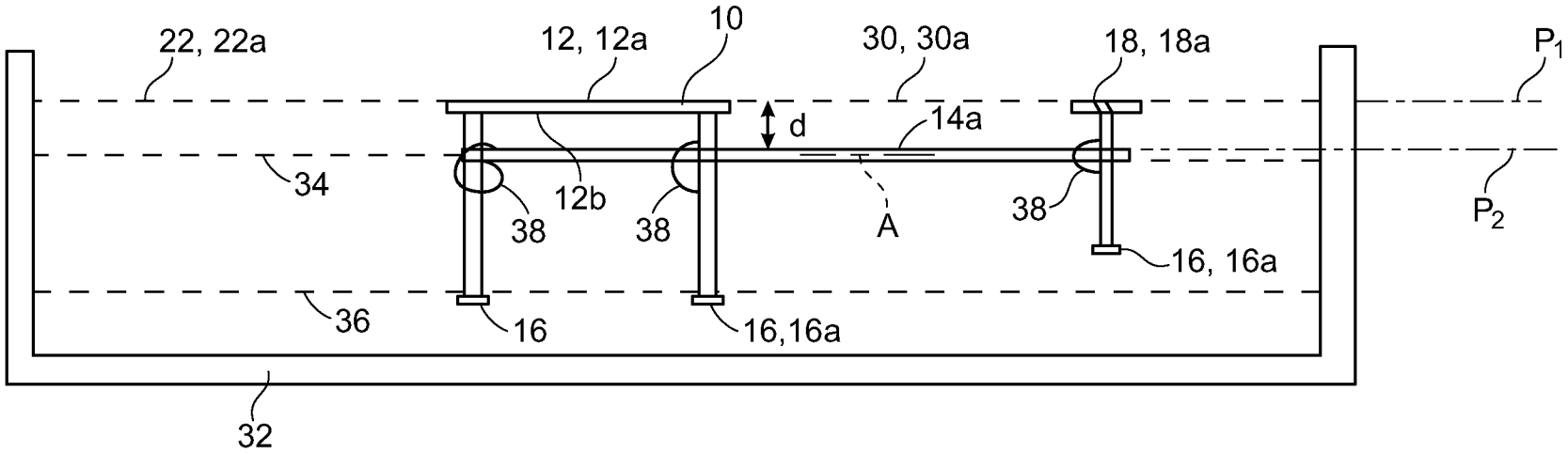
FIG. 11 is a side schematic drawing of a portion of a concrete wall being formed in a concrete wall casting form, incorporating an embodiment of a corbel mounting assembly.

Referring to FIG. 11, corbel mounting assembly 10 is shown being formed into a concrete structure such as a wall 22. Two layers of rebar cages, front cage 34 and rear cage 36 can be positioned within the concrete structure or wall casting form 32. The corbel mounting assembly 10 is positioned in place and fastened to front cage 34 with fasteners 38 such as wire. Temporary removable plugs can be inserted into slots 13*a* and 13*b* in the corbel mounting plate 12 to prevent the slots 13*a* and 13*b* from being filled with concrete. Concrete 30 is poured into the wall casting form 32 with the surface 30*a* of the concrete 30 being level with the mounting plane $P_1$ of the corbel mounting assembly 10. As a result, the surface 30*a* of the concrete 30 can be flush with the front surfaces 12*a* and 18*a* of corbel mounting plate 12 and beam securement plate 18, at a distance d such as 1½ inches above connecting member surface plane $P_2$ and the front surfaces 14*a* of the connecting rods 14. The surface 30*a* of the concrete 30 when cured, forms the front outer surface 22*a* of concrete wall 22. By having the beam securement plate 18 rigidly secured to the corbel mounting plate 12 prior to pouring the concrete 30, the spacing and alignment in the X, Y and Z axes between the plates 18 and 12 can be controllably preset prior to insertion into the wall casting form 32. This increases the speed at which the corbel mounting plate 12 and beam securement plate 18 can be set up in the wall casting form 32 and eliminates the need for external positioning jigs above the wall form 32, which also makes smoothing or spreading out the surface 30*a* of the poured concrete 30 faster and easier. The corbel mounting assembly 10 can allow a concrete wall 22 to be poured in about half the time than the prior art methods. Furthermore, by having the corbel mounting plate 12 and beam securement plate 18 aligned relative to each other in the X, Y and Z axes, the plates 26 of each double Tee beam 24 can be welded to each beam securement plate 18 with consistent repeatable characteristics, improving quality control.

Figure 12:
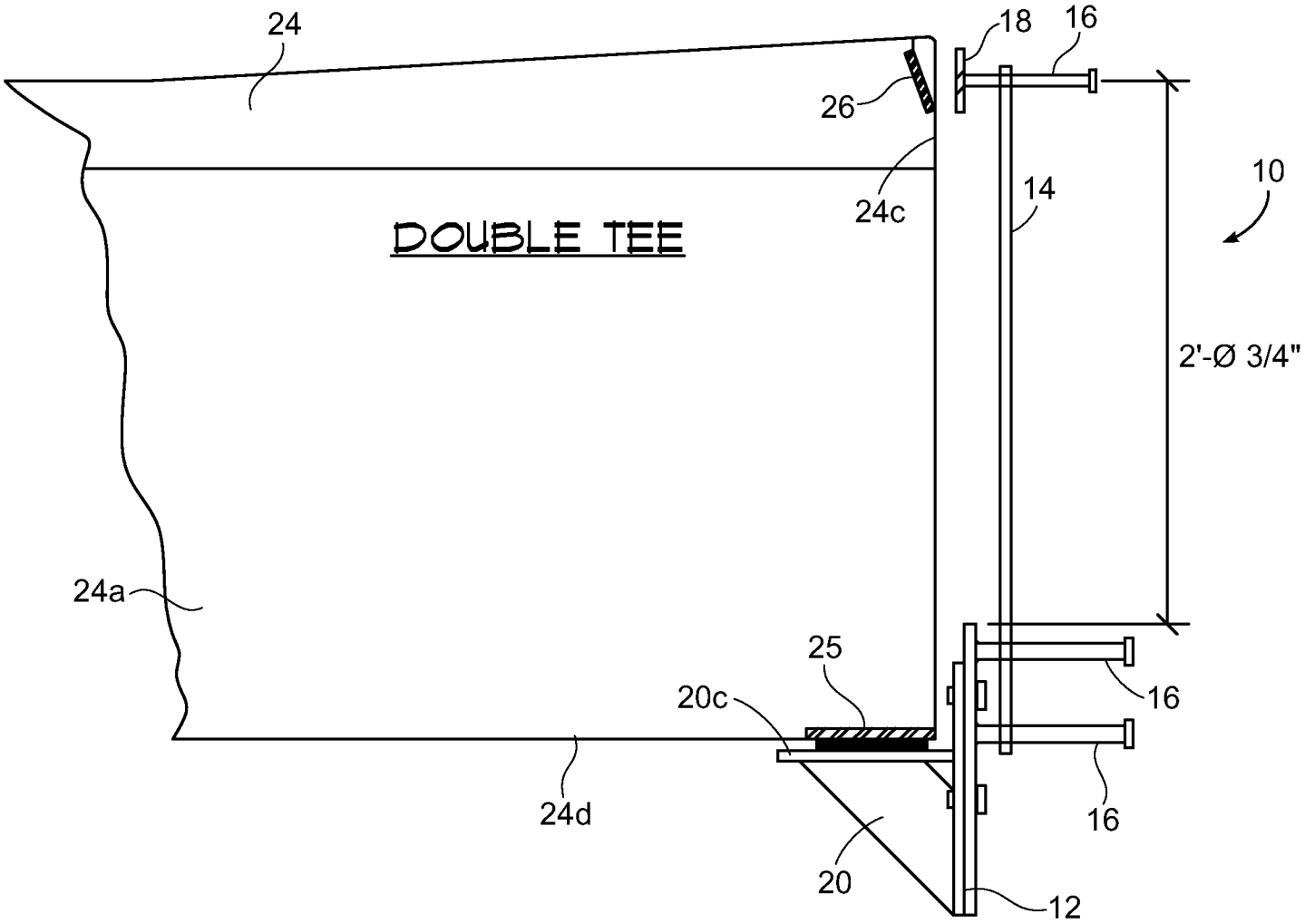
FIG. 12 is a side view of another embodiment of a corbel mounting assembly supporting a double Tee beam.
Figure 13:
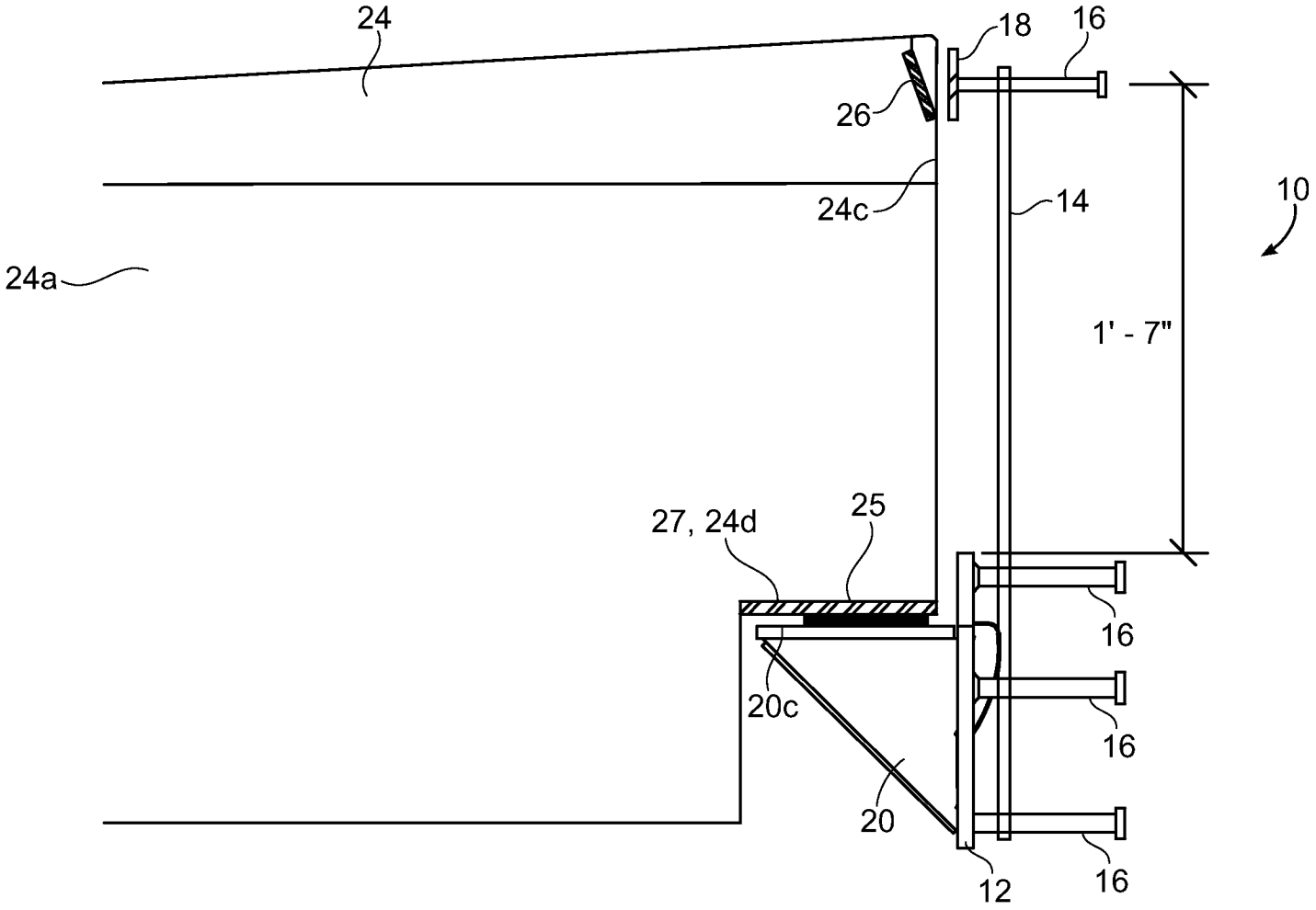
FIG. 13 is a side view of still another embodiment of a corbel mounting assembly supporting a double Tee beam.

Referring to FIGS. 12 and 13, the distance or spacing of the center of the beam securement plate 18 from the top of the corbel mounting plate 12 of the corbel mounting assembly 10 can vary, and some embodiments can have spacings of 16¼ inches (about 16 inches), 19 inches, 20 inches, 24¾ inches (about 24 inches), 27½ inches (about 27 inches), and 28½ inches (about 28 inches). FIGS. 12 and 13 show spacings of 24¾ inches and 19 inches, respectively. Some embodiments of the corbel mounting assembly 10 can include two lateral rows of anchor rods 16 extending from the upper half or portion of the corbel mounting plate 12 (FIG. 12), and other embodiments can include three lateral rows of anchor rods 16 extending from the top, middle and bottom portions of the corbel mounting plate 12 (FIG. 13). The bottom surface 24*d* of the double Tee beam 24 can include a metal or steel plate 25 that can be supported by the upper surface 20*c* of the corbel 20 with a pad, or can be welded to the upper surface 20*c*. In some embodiments, the double Tee beam 24 can have a recess, step or notch 27 with an elevated or recessed bottom surface 24*d* that is supported by the corbel 20. In some embodiments, the plate 26 on the end 24*c* of the double Tee beam 24 can have the upper edge slightly angled away from the beam securement plate 18 to facilitate welding to the beam securement plate 18.

While example embodiments have been particularly shown and described, it will be understood by those skilled in the art that various changes in form and details may be made therein without departing from the scope of the embodiments encompassed by the appended claims.

For example, in embodiments of the corbel mounting assembly 10, the dimensions of the different components can vary depending upon the situation at hand, and the size of the double Tee beam to be supported. Although terms such as front, rear, rearwardly, top, bottom, wide, high, etc. have been used, it is understood that such terms can differ depending upon the spatial orientation of the corbel mounting assembly 10. Furthermore, the connecting member can be a single member or include multiple members such as more than two connecting members or rods 14. In addition to the connecting rods 14 and anchor rods 16 having a round cross section, the connecting rods 14 and anchor rods 16 can have other suitable cross sections such as rectangular, polygonal or oval etc. The configuration, number, size and placement of the anchor members can also vary. The corbel mounting assembly 10 can also be used in other concrete structures, such as in columns. Features of different embodiments shown and/or described can be combined together or omitted.

What is claimed is:

1. A corbel mounting assembly for a concrete structure comprising:

a corbel mounting member having a concrete anchor arrangement and a planar corbel mounting surface, the planar corbel mounting surface extending along a mounting plane; and a beam securement member having a concrete anchor arrangement and a planar beam securement surface, the beam securement member being rigidly secured to and spaced apart from the corbel mounting member by a connecting member, the planar corbel mounting surface and the planar beam securement surface being aligned with each other along the mounting plane, the connecting member having a connecting member surface extending along a connecting member surface plane that is spaced apart from and parallel to the mounting plane, the connecting member extending interactively relative to the concrete anchor arrangements of the corbel mounting member and the beam securement member, each of the concrete anchor arrangements extending from respective corbel mounting and beam securement members in a direction opposite to the mounting plane.

2. The corbel mounting assembly of claim 1 in which the corbel mounting member and the beam securement member are each formed of planar steel plates.

3. The corbel mounting assembly of claim 2 in which the concrete anchor arrangements of the corbel mounting member and the beam securement member each comprise at least two elongate anchor members rigidly extending from respective corbel mounting and beam securement members in the direction opposite to the mounting plane.

4. The corbel mounting assembly of claim 3 in which the connecting member comprises two parallel elongate steel bars rigidly secured to respective anchor members on the corbel mounting member and the beam securement member, the connecting member surface of the two steel bars extending along the connecting member surface plane spaced apart from the mounting plane about 1½ inches.

5. The corbel mounting assembly of claim 4 in which the corbel mounting member is about 15 to 18 inches wide by 12 to 14 inches high and ½ inch thick, the beam securement member is about 7 to 10 inches wide by 2 to 4 inches high and ½ inch thick, the elongate steel bars are about ½ inch in diameter, and a height of the corbel mounting assembly is about 27 to 48 inches high.

6. The corbel mounting assembly of claim 4 in which a corbel is mounted to the planar corbel mounting surface.

7. The corbel mounting assembly of claim 6 in which the corbel mounting assembly is embedded in a concrete wall and is part of a beam mounting assembly, the planar corbel mounting surface and the planar beam securement surface extending along an exterior surface of the concrete wall, an upper surface of the corbel supporting a bottom of a beam, the planar beam securement surface being rigidly secured to an end of the beam, thereby rigidly holding the beam on the upper surface of the corbel with rigid connection of the beam securement member to the corbel mounting member by the connecting member.

8. A corbel mounting assembly comprising:

a corbel mounting plate having at least two concrete anchor members and a planar corbel mounting surface, the planar corbel mounting surface extending along a mounting plane; and a beam securement plate having at least two concrete anchor members and a planar beam securement surface, the beam securement plate being rigidly secured to and spaced apart from the corbel mounting plate by a connecting member having two parallel elongate bars rigidly secured to respective anchor members on the corbel mounting plate and the beam securement plate, the planar corbel mounting surface and a planar beam securement surface being aligned with each other along the mounting plane, the two parallel elongate bars of the connecting member having a connecting member surface extending along a connecting member surface plane that is spaced apart from and parallel to the mounting plane, each of the concrete anchor members extending from respective corbel mounting and beam securement plates in a direction opposite to the mounting plane.

9. A method of forming a corbel mounting assembly for a concrete structure comprising:

providing a corbel mounting member having a concrete anchor arrangement and a planar corbel mounting surface, the planar corbel mounting surface extending along a mounting plane; and rigidly securing a beam securement member to the corbel mounting member in a spaced apart manner with a connecting member, the beam securement member having a concrete anchor arrangement and a planar beam securement surface, the planar corbel mounting surface and the planar beam securement surface being aligned with each other along the mounting plane, the connecting member having a connecting member surface extending along a connecting member surface plane that is spaced apart from and parallel to the mounting plane, the connecting member extending interactively relative to the concrete anchor arrangements of the corbel mounting member and the beam securement member, each of the concrete anchor arrangements extending from respective corbel mounting and beam securement members in a direction opposite to the mounting plane.

10. The method of claim 9 in which the corbel mounting member and the beam securement member are each formed of planar steel plates.

11. The method of claim 10 further comprising providing the concrete anchor arrangements of the corbel mounting member and the beam securement member each with at least two elongate anchor members rigidly extending from respective corbel mounting and beam securement members in the direction opposite to the mounting plane.

12. The method of claim 11 further comprising providing the connecting member with two parallel elongate steel bars rigidly secured to respective anchor members on the corbel mounting member and the beam securement member, the connecting member surface of the two steel bars extending along the connecting member surface plane spaced apart from the mounting plane about 1½ inches.

13. The method of claim 12 in which the corbel mounting member is about 15 to 18 inches wide by 12 to 14 inches high and ½ inch thick, the beam securement member is about 7 to 10 inches wide by 2 to 4 inches high and ½ inch thick, the elongate steel bars are about ½ inch in diameter, and a height of the corbel mounting assembly is about 27 to 48 inches high.

14. The method of claim 12 further comprising mounting a corbel to the planar corbel mounting member.

15. The method of claim 14 further comprising embedding the corbel mounting assembly in a concrete wall, the planar corbel mounting surface and the planar beam securement surface extending along an exterior surface of the concrete wall.

16. The method of claim 15 further comprising forming a beam mounting assembly comprising:

supporting a bottom of a beam with an upper surface of the corbel; and rigidly securing an end of the beam to the planar beam securement surface, thereby rigidly holding the beam on the upper surface of the corbel with rigid connection to the beam securement member to the corbel mounting member by the connecting member.

* * * * *